US005116017A

United States Patent [19]

Granger et al.

[11] Patent Number: 5,116,017

[45] Date of Patent: * May 26, 1992

[54] ANNULAR SEALING ELEMENT WITH SELF-PIVOTING INSERTS FOR BLOWOUT PREVENTERS

[76] Inventors: Stanley W. Granger, 23800 Gold Nugget, Diamond Bar, Calif. 91765; Joseph O. Beard, 1625 N. Lincoln Ave., Fullerton, Calif. 92631; Frode Sveen, 12697 Orgren Ave., Chino, Calif. 91710

[ * ] Notice: The portion of the term of this patent subsequent to Aug. 21, 2007 has been disclaimed.

[21] Appl. No.: 600,311

[22] Filed: Oct. 18, 1990

[51] Int. Cl.[5] ..... E21B 33/06

[52] U.S. Cl. ..... 251/1.2

[58] Field of Search ..... 251/1.2; 277/235 R

[56] References Cited

U.S. PATENT DOCUMENTS 3,561,723 2/1971 Cugini ..... 251/1.2

4,949,785 8/1990 Beard et al. ..... 251/1.2 X

*Primary Examiner*—John C. Fox

*Attorney, Agent, or Firm*—William L. Chapin

[57] ABSTRACT

An improved annular sealing element for oil well blowout preventers includes a plurality of curved metal segments spaced apart at regular circumferential angles and imbedded in a resilient matrix forming a generally lenticular-shaped body with a hollow central bore. Each segment has a tooth-like upper plate section having a downwardly depending web which is pivotably joined to the upper surface of a wedge-shaped base plate. Pivotability in a vertical plane of the upper plate section relative to the base plate limits the force exertable by the sealing element on a drill string component within the bore of the element. A cylindrical pivot bar formed in the lower surface of the base plate of each segment is adapted to roll or self-pivot on the annular head of a driver piston, thus allowing the sealing element to be installed in existing blowout preventers withou modification of the driver piston.

10 Claims, 3 Drawing Sheets

ANNULAR SEALING ELEMENT WITH SELF-PIVOTING INSERTS FOR BLOWOUT PREVENTERS

BACKGROUND OF THE INVENTION

A. Field of the Invention

The present invention relates to apparatus for use in the drilling and operation of sub-surface wells, particularly oil wells and geothermal wells. More particularly, the invention relates to an improved annular sealing element for use in existing blowout preventers of the type used to prevent pressurized subterranean liquids or gases from blowing out and upwards through a well hole.

B. Discussion of Background Art

In drilling for natural gas or liquid petroleum, a drill string consisting of many lengths of threaded pipes screwed together and tipped with a drill bit head is used to bore through rock and soil. The drill bit head has a larger diameter than the pipes forming the drill string above it. A rotary engine coupled to the upper end of the drill string transmits a rotary boring action to the drill bit head.

During the drilling operation, a specially formulated mud is introduced into an opening in an upper drill pipe. This mud, which typically is selected to have a high specific gravity, flows downwards through the hollow interior of the pipes in the drill string and out through small holes or jets in the drill bit head. Since the drill bit head has a larger diameter than the drill string above it, an elongated annular space is created during the drilling process. The annular space permits the mud to flow upwards to the surface. Mud flowing upwards carries drill cuttings, primarily rock chips, to the surface. The mud also lubricates the rotating drill string, and provides a downward hydrostatic pressure which counteracts pressure which might be encountered in subsurface gas pockets.

In normal oil well drilling operations, it is not uncommon to encounter subsurface gas pockets whose pressure is much greater than could be resisted by the hydrostatic pressure of the elongated annular column of drilling mud. To prevent the explosive and potentially dangerous and expensive release of ga and/or liquid under pressure upwards out through the drilling hole, blowout preventers are used. Blowout preventers are mounted in a pipe casing surrounding a drill hole, near the upper end of the hole.

Typical blowout preventers have a resilient sealing means which can be caused to tightly rip the outer circumferential surfaces of various diameter drill string components, preventing pressure from subterranean as pockets from blowing out material along the drill string. Usually, the resilient sealing means of a blowout preventer is so designed as to permit abutting contact of a plurality of sealing elements, when all elements of a drill string are removed from the casing. This permits complete shutoff of the well, even with all drill string elements removed. Most oil well blowout preventers are remotely operable, as, for example, by a hydraulic pressure source near the drill hole opening having pressure lines running down to a hydraulic actuator cylinder in the blowout preventer.

Blowout preventers having resilient sealing means are disclosed in U.S. Pat. No. 3,323,773, R. W. Walker.

Jun. 6, 1967, and U.S. Pat. No. 3,667,721, issued Jun. 6, 1972 to A. N. Vujasinovic.

Prior blowout preventers, including those disclosed in the above-identified U.S. patents, typically use a circularly spaced array of curved metal segments which are contained slidably in a hemispherical cavity and pushed upwards by a hydraulic piston to effect a reduction in diameter of an upward entrance bore to the hemispherical cavity, through which drill string components are inserted. The curved metal segments are held in a circumferentially spaced-apart relationship by being molded integrally into a resilient rubber matrix having a generally cylindrical interior shape. When the sealing element comprising the curved metal segments and resilient matrix are moved upwards, the inner cylindrical rubber surface is forced to cold-flow inwards towards the outer circumferential surface of the drill string components within the blowout preventer, thereby effecting a seal and preventing pressurized fluids below the blowout preventer from escaping upwards. In some prior art blowout preventers, inward movement of rubber is sufficient to completely seal the bore through the blowout preventer, even with all drill string components withdrawn.

Existing blowout preventers can damage drill string component under certain conditions. Since the metal segments used in the sealing element of some blowout preventers are non-resiliently translated longitudinally upward and radially inward by the actuator piston, the upper inner edges of the segments can contact the circumferential surface of a drill string component with radial compressive forces sufficient to damage the component. With this and other limitations of prior blowout preventers in mind, the present inventors developed an improved blowout preventer which incorporates force-limiting means for preventing rigid metal segments in the annular sealing element of the blowout preventer from being forced against drill string components sufficiently hard to damage those components. The improved blowout preventer was disclosed in U.S. patent application Ser. No. 054,932 filed May 27, 1987. That application resulted in the issuance on Aug. 22, 1989 of U.S. Pat. No. 4,858,882, Beard, Granger and Sveen. Blowout Preventer With Radial Force Limiter.

One embodiment of applicants' above-referenced Blowout Preventer With Radial Force Limiter uses an annular sealing element in which metal sealing elements are moved in front of resilient elastomeric material interposed in the path extending from an actuating piston to the metal sealing elements and thence to the outer cylindrical surface of a drill string component within the bore of the blowout preventer. The compressibility of the resilient material limits the force exertable by the rigid sealing elements on the drill string component.

A novel sealing element used in another embodiment of applicants' improved blowout preventer referenced above uses metal sealing segments made of two parts which are moveable with respect to one another. The freedom of one part of a metal sealing segment to move with respect to the other part of the segment limits the force exertable by the metal segments on drill string components as the actuating piston of the blowout preventer moves the sealing element into a closing position.

Subsequent to their invention of the Improved Blowout Preventer disclosed in U.S. Pat. No. 4,858,882, the present inventors developed an improved sealing element for blowout preventers. That improved sealing element not only includes means for limiting the radial force which the sealing element may exert on a drill string component, but also includes means for compensating for wear of resilient portions of the sealing element, thus maintaining sealing effectiveness for a greater number of operational cycles. The improved sealing element was disclosed in U.S. patent application Ser. No. 07/346,415 filed May 2, 1989 and titled Force-Limiting/Wear Compensating Annular Sealing Element For Blowout Preventers, now U.S. Pat. No. 4,949,785, Aug. 21, 1990. Beard, Granger and Sveen.

The present invention was conceived of to provide a further improved annular sealing element for blowout preventers. This sealing element incorporates some of the advantageous features of the novel sealing elements previously disclosed by the present inventors, and also has additional novel features which enhance the usefulness of the sealing element.

OBJECTS OF THE INVENTION

An object of the present invention is to provide an improved force-limiting sealing element for blowout preventers which has an enhanced capacity for feeding resilient material into sealing contact with drill string components within the bore of the sealing element.

Another object of the invention is to provide an annular sealing element for blowout preventers which incorporates into a resilient matrix metal inserts which have integral pivot bars in their bases, permitting the elements to self-pivot on the head of a standard blowout preventer piston, eliminating the need for installing a beveled cap ring on the piston, and thereby simplifying installation of the sealing element.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved annular sealing element for oil well blowout preventers of the type employing an actuating piston to drive a sealing element having metal segments embedded in a resilient matrix upwards and radially inwards within a curved cavity within the blowout preventer housing to seal a longitudinal bore through the cavity.

The improved blowout preventer sealing element according to the present invention has a generally circularly symmetric, lenticular-shaped body having a flat base, a convexly curved upper wall surface, and a cylindrical bore of substantial diameter, relative to the outer diameter of the body, extending coaxially through the body. The sealing element includes a plurality of curved metal segments spaced apart at regular circumferential intervals. Each segment comprises an upper part pivotably joined to a lower part. The upper part of each segment has in plan view the shape of a sector of a sphere which is truncated by a short upper chordal plane and a longer lower chordal plane. The upper part of each segment has a convexly curved outer surface coextensive with upper curved surface of the lenticular body.

Metal segments of the improved sealing element are imbedded in a resilient matrix of rubber or similar elastomeric material, thus forming with the elastomer material a composite structure. The upper part of each of the metal segments comprises a curved tooth-like upper plate section and a vertically oriented supporting web of uniform thickness extending perpendicularly downwards from the mid-point of the plate section. The lower part of each metal segment includes a base or compensator plate having in plan-view the shape of a truncated sector of a circle similar to the shape of the upper plate section. The wider, rear part of the base plate, has a slightly convexly curved lower surface. The upper surface of the base plate has a longitudinally disposed groove for pivotably supporting the lower end of the web. Bosses formed in opposite side walls of the base plate support a cylindrical pivot pin for pivotably supporting the web. An important advancement of our present sealing element over our previously disclosed sealing element comprises a cylindrical pivot or rocker bar which protrudes downwards from the bottom surface of the rear part of the base plate.

The narrower, shorter part of the base plate forward of the web support pivot pin has a more generally flat, lower surface, beveled at an upward dihedral angle with respect to the wider, curved rear lower surface. The cylindrical pivot bar is parallel to and rearward of the pivot pin and functions as follows.

The curved lower surface of the pivot bar of each of the metal segments in the sealing element is adapted to seat directly on the upper annular head surface of an annular blowout actuator piston, without requiring the piston head to be modified by the attachment on a bevelled annular piston cap ring thereto.

Upward motion of the blowout preventer actuator piston forces the base plates of the segments upwards. This upward motion in turn forces the upper teeth-like portions of the metal segments, which ride conformally on the curved hemispherical surface of the cavity within the blowout preventer housing, upwards and radially inwards to close on the bore within the cavity. Radially inward and longitudinally upward motion of the tooth-like upper portions of the steel segments forces the resilient portion of the sealing element in which the segments are imbedded to cold-flow inwards to make sealing contact with a drill string component in the bore. In the absence of a drill string component within the bore of the cavity, inner diametrically opposed side walls of the resilient portion of the sealing element matrix cold-flow inwards into sealing contact with one another, to seal off the bore.

In the novel design of the metal segments of the sealing element according to the present invention, the smaller portion of each segment base plate, forward of the pivot pin, functions as a toe plate, supporting and directing the cold-flow of rubber towards the center line of the sealing element bore. This action increases the longitudinal length of the resulting seal, greatly improving the capability of the seal to contain higher pressures than prior art seals. Additionally, the toe portion of the base plate of each steel segment provides a highly effective means of feeding rubber into the seal area, compensating for rubber wear due to the abrading action of drill string components having been pulled through the bore of the sealing element. Thus, the base plate of the novel sealing element according to the present invention serves as a highly effective compensator plate, for compensation for wear of the resilient portion of the sealing element, greatly increasing the effective operational life of the sealing element.

Importantly, the convex cylindrical surface of the pivot bar in the improved sealing element rolls or self-pivots a substantial amount around its own axis, in contact with the piston head. Rotation of the pivot bar on the piston head causes the compensator plate to rotate a greater amount for a given longitudinal excursion of the actuator piston than prior art sealing elements. This results in feeding more rubber into regions to be sealed.

DETAILED DESCRIPTION OF THE INVENTION

Figure 1:
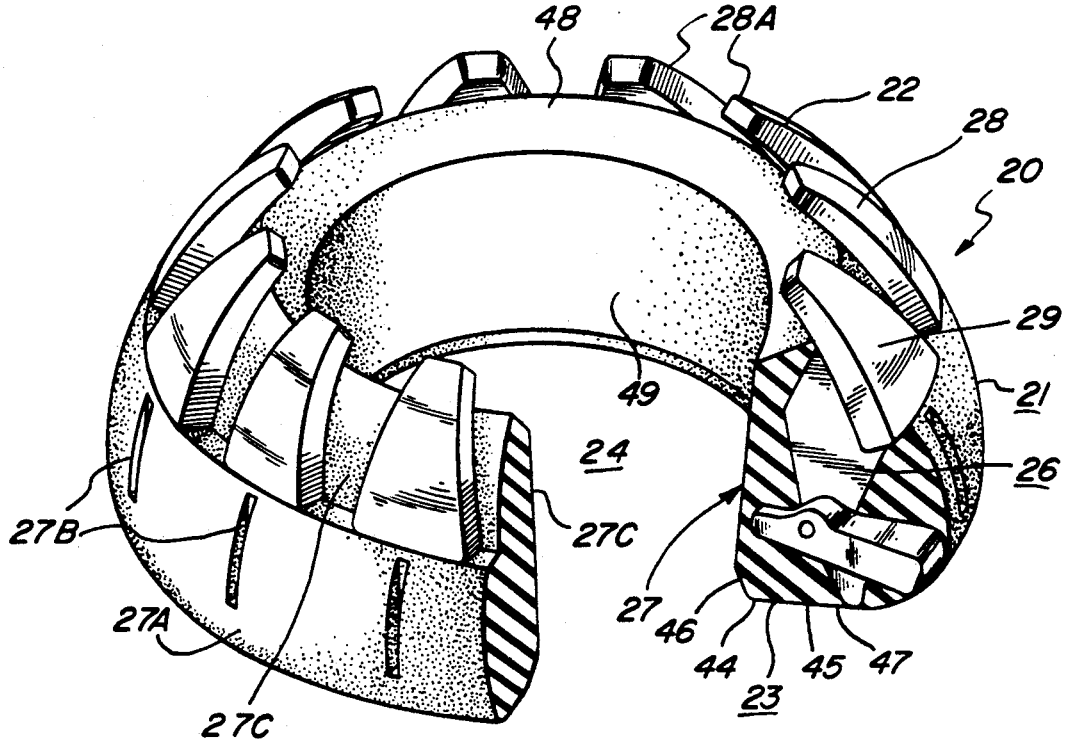
FIG. 1 is a fragmentary perspective view of an improved sealing element according to the present invention, showing a radial section removed to show the composite structure of the sealing element.

Referring now to FIGS. 1 through 8, an improved annular sealing element with self-pivoting inserts for blowout preventers, constructed according to the present invention is shown. The improved annular sealing element according to the present invention is intended for use in blowout preventers of the type using an actuating piston to drive a sealing element having metal segments embedded in a matrix made of rubber or similar resilient material. In such blowout preventers, upward motion of the actuating piston forces the sealing element upwards and radially inwards within a curved hemispherical cavity within the blowout preventer, causing cold-flow of the resilient matrix into sealing contact with a drill string component within the bore, or upon itself in the absence of a drill string component. The improved annular sealing element according to the present invention includes means for limiting the force which metal segments in the element may exert on a drill string component. Also, the novel annular sealing element according to the present invention includes means for compensating for wear of the resilient matrix.

Referring now primarily to FIGS. 1 through 5, the annular sealing element 20 according to the present invention is seen to comprise a circularly symmetric, lenticular-shaped body 21 having convexly curved upper sides 22, a generally flat annular base surface 23, and a coaxial central bore 24 of substantial diameter relative to the outer diameter of the body, the bore extending completely through the body.

Figure 6:
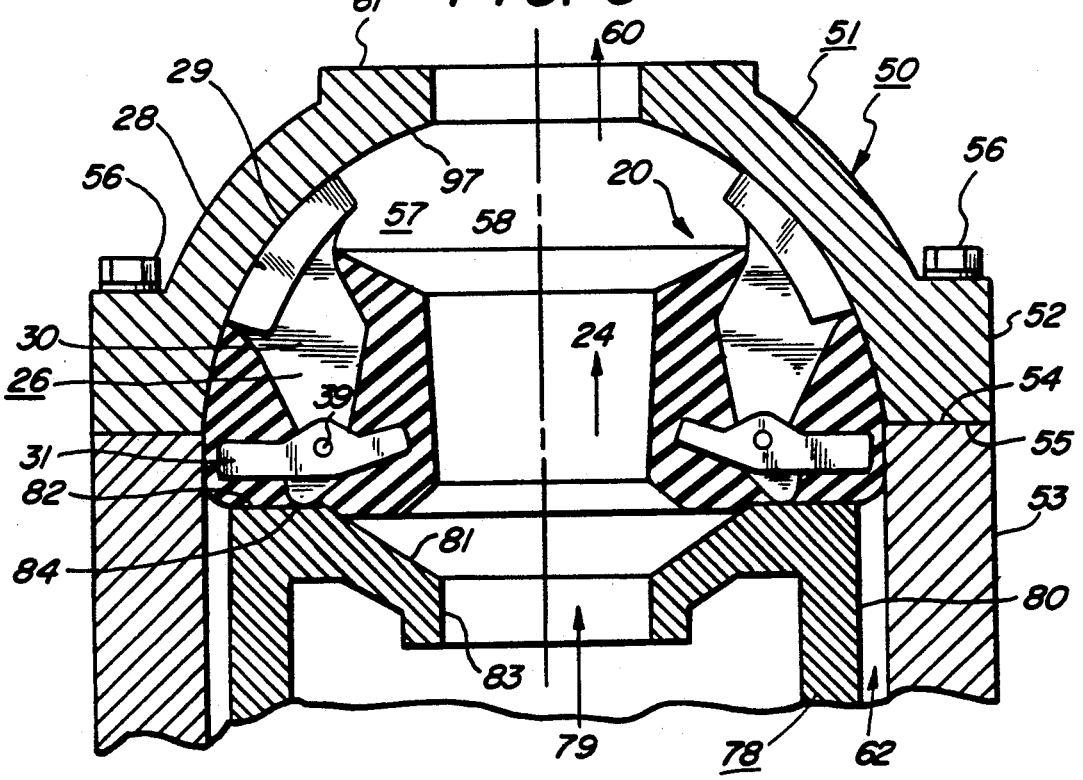
FIG. 6 is a fragmentary longitudinal sectional view of the sealing element of FIG. 1, showing the sealing element installed in a blowout preventer and showing the sealing element in an open position.
Figure 2:
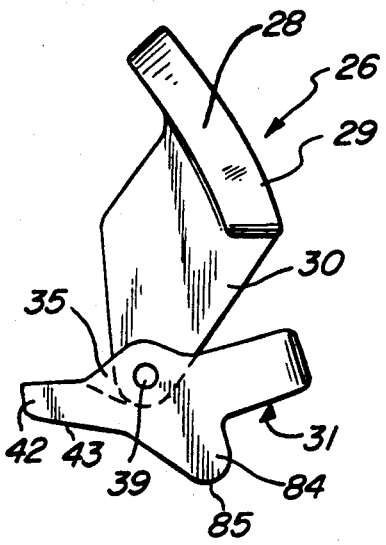
FIG. 2 is a side elevation view of a novel metal segment forming part of the sealing element of FIG. 1.
Figure 3:
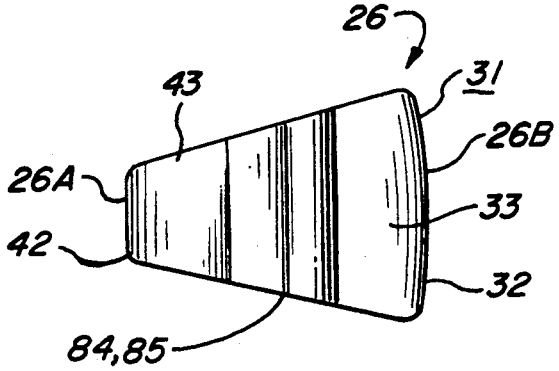
FIG. 3 is a lower plan view of the segment of FIG. 2.

As may be seen best by referring to FIG. 6, the annular sealing element 20 is adapted to installation within a blowout preventer 50, in which the housing 51 of the blowout preventer is typically made of an upper section 52 and lower section 53. The upper and lower housing sections 52 and 53 of the housing 51 have a generally circularly symmetric shape, and are sealingly joined to one another along transversely disposed lower and upper annular mating surfaces 54 and 55 respectively, by bolts 56. Some blowout preventers use a plurality of segmented locking wedges held in place by a locking ring, rather than bolts, to secure the upper and lower housing sections together.

The housing 51 of the exemplary blowout preventer 50 of the type in which the annular sealing element 20 is intended to be installed, has a generally circularly symmetric hollow interior space 57, formed of a generally hemispheric interior space 58 in upper housing section 52, and a generally annular-shaped interior space 59 in lower housing section 53. A bore 60 through the upper wall 61 of upper housing section 52 is provided to permit communication between the bore of an upper well casing, not shown, which may be attached to the blowout preventer, and the hemispherical interior space 58 of the upper housing section. A bore 62 is also provided through lower housing section 53. Bore 62 provides communication between the bore of a lower well casing, not shown, which may be attached to the blowout preventer, and the hemispherical interior space 58 of upper housing section 52.

As shown in FIG. 6, the blowout preventer 50 includes a circularly symmetric piston 78 having a hollow central bore 79 and downwardly depending cylindrical walls 80. The upper surface of the piston 78 has a flat annular ring section 82 which extends radially inwards some distance from the outer surface of the cylindrical wall 80. Beginning at the inner edge of the annular ring section 82, the upper surface 81 of the piston 78 slopes downward and inward to the central bore 79, the surface terminating in a downwardly projecting, hollow boss 83. Boss 83 is cylindrically shaped, and coaxial with outer cylindrical wall 80 of piston 78.

As shown in FIG. 6, annular base 23 of sealing element 20 seats on annular ring section 82 of piston 78. Convexly curved upper sides 22 of sealing element 20 slidingly conform to the curved hemispherical surface 97 of upper housing section 52.

Having described how the annular sealing element 20 fits within a blowout preventer 50, details of the novel structure of the sealing element will now be described. Following this, a description of the novel operation of the sealing element 20 within a blowout preventer 50 is given.

Referring now to FIGS. 1 through 6, it may be seen that the sealing element 20 according to the present invention is a composite structure, containing metal segments 26 integrally molded into a generally cylindrical matrix 27. Matrix 27 is made of a resilient material such as hard rubber or similar elastomer.

As may be seen best by referring to FIGS. 2 through 5, each metal segment 26 has in plan view the shape of a sector of a sphere, the upper or front vertex of which section is truncated by a short curved chordal plane 26A. The lower or rear edge of the sector is terminated by a longer curved chordal plane 26B. The upper surface of each segment 26 has a convexly curved outer surface 29 which is co-extensive with the upper curved surface of the lenticular body 21.

The upper part of each of the metal segments 26 includes a tooth-like upper plate section 28 having a convexly curved upper outer surface 29. The upper plate section 28 has a vertically oriented supporting web 30 of uniform thickness, which extends perpendicularly downwards from the mid-point of the plate section. Preferably, upper plate section 28 and web 30 are cast in one piece from alloy steel.

The lower part of each metal segment 26 includes a base plate 31 having in plan view the shape of a truncated sector of a circle, similar to the shape of the upper tooth-like plate section 28. As may be seen best by referring to FIG. 3, the rear portion 32 of base plate 31 has a slightly convexly curved lower surface 33. Formed in the rear portion of lower surface 33 is a generally cylindrically shaped rocker or pivot bar 84. Pivot bar 84 has a convex lower cylindrical surface 85, and is disposed perpendicularly to the longitudinal mid-plane of base plate 31.

Figure 4:
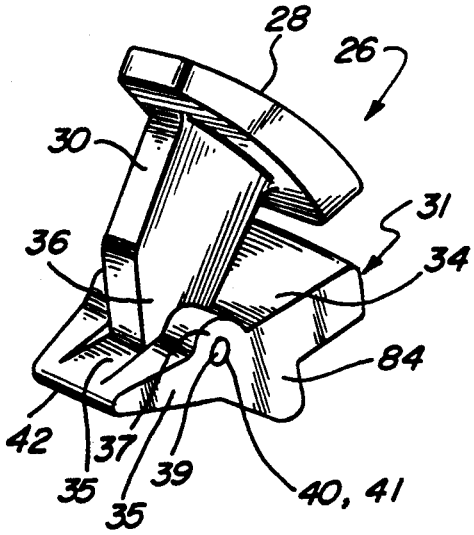
FIG. 4 is a front elevation view of the segment of FIG. 2.
Figure 5:
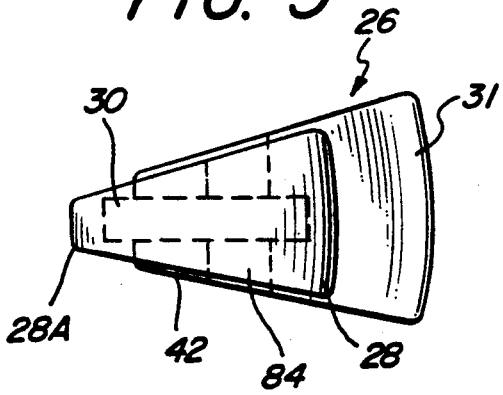
FIG. 5 is an upper plan view of the segment of FIG. 2.

As may be seen best by referring to FIGS. 4 and 5, the upper surface 34 of the base plate 31 contains a longitudinally disposed groove 35. Groove 35 pivotably supports the lower end 36 of web 30. Bosses 37 formed in opposite side walls 38 of the base plate 31 support a cylindrical pivot pin 39 held within holes 40 through the bosses. Pivot pin 39 also passes through a hole 41 in the lower end 36 of web 30. The rotational axis of pivot pin 39 is located longitudinally forward of, and above the rotational axis of pivot bar 84.

As shown in FIGS. 2 through 5, base or compensator plate 31 of segment 26 includes a wedge-shaped "toe" section 42 which extends forward of the pivot pin 39. The toe section 42 has a lower surface 43 which is more generally flat than the curved lower surface 33 of the rear portion or "heel" 32 of the base plate 31. Lower surface 43 of toe section 42 is beveled at an upward dihedral angle with respect to the curved lower surface 33 of the heel section 32 of the base plate 31.

The purpose of the upward bevel in lower surface 43 of front toe section 42 of base plate 31 is to ensure that an adequate volume of resilient matrix 27 will be forced into sealing contact with inner beveled annular surface 81 of piston 78. This will be explained in more detail in conjunction with the discussion of the operation of the invention, with reference to FIG. 6. An important function of the upper surface of the front toe section 42 of compensator base plate 31 is to force and direct the upward and inward cold-flow of resilient matrix 27 into a sealing position, as is explained in detail below.

As may be seen best by referring to FIG. 1, each metal segment 26 of sealing element 20 is retained in the molded resilient matrix 27 at equal circumferential angles, equidistant from the longitudinal center line of the bore 24 through the sealing element, thus forming a ring-shaped structure having an upwardly and inwardly curving convex outer side. The inner portion 27C of resilient matrix 27 has a generally cylindrical shape whose height is less than that of the upper ends of tooth-like plate sections 28 of segments 26.

As may be seen best by referring to FIG. 1, the entire base plate 31 of each segment 26 is completely enclosed within the lower portion 27A of the molded matrix 27.

The lower surface 44 of molded matrix 27 has three different shapes, including a relatively wide annular center surface 45 which slopes generally upwards and outwards, and serves as a sealing contact surface with piston 78, as will be described below. Lower surface 44 also has an upwardly and inwardly beveled inner annular surface 46, and an upwardly and outwardly beveled outer annular surface 47. The upper annular surface 48 of the resilient matrix 27 is beveled downwards and inwards from the inner, or lower surface of the teeth-like upper plate sections 28 of segments 26, towards the inner cylindrical wall surface 49 encompassing bore 24 of the sealing element 20.

As may be seen best by referring to FIG. 1, molded matrix 27 has an outer, lower annular ring-shaped portion 27A which extends upwards from lower surface 44 of the matrix, up to the outer, lower transverse walls of tooth-like upper plate sections 28 of steel segments 26, forming a continuous, smooth convexly curved surface with the outer surfaces 29 of the tooth-like sections. Vertically disposed slots 27B are provided in the outer wall surface of lower ring-shaped portion 27A. Sealing element 20 is preferably manufactured in an inverted position, in which segments 26 are held in place in a mold in which the resilient matrix material 27 is cast around the segments. Slots 27B are provided for lugs within the mold to support segments 26 in their proper position during the molding process. Molded matrix 27 also includes an inner ring-shaped portion 27C, having an upper annular wall surface 48. The height of inner portion 27C is less than that of segments 26, thus positioning surface 48 below the upper edges 28A of tooth-like upper plate sections 28.

OPERATION OF THE INVENTION

Figure 7:
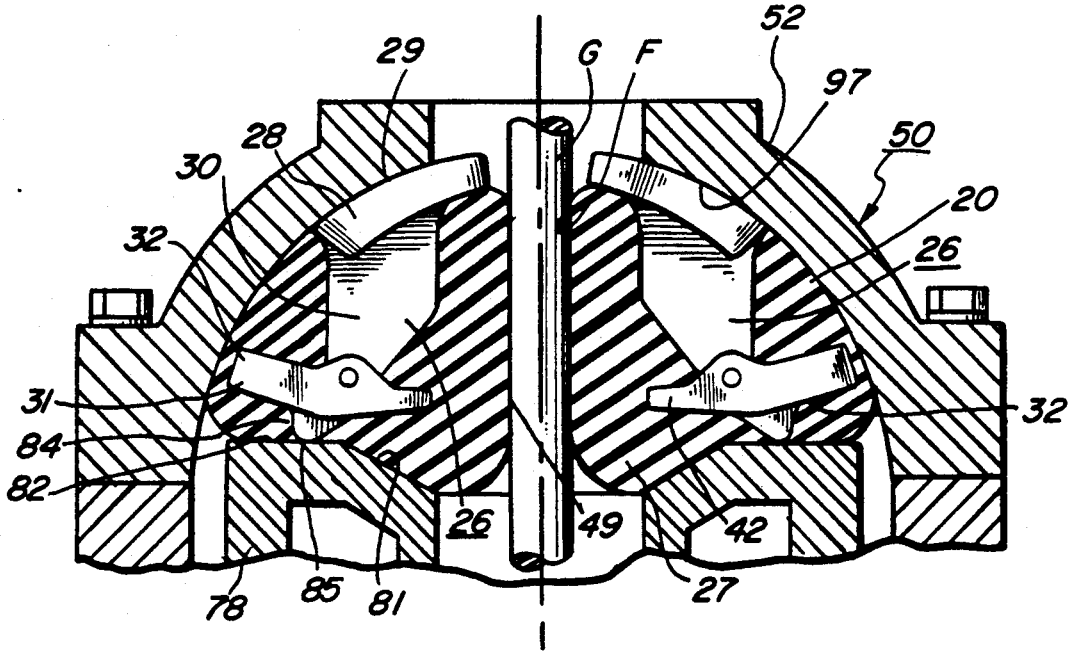
FIG. 7 is a view similar to FIG. 6, but showing the sealing element in sealing peripheral contact with a cylindrical drill string component.
Figure 8:
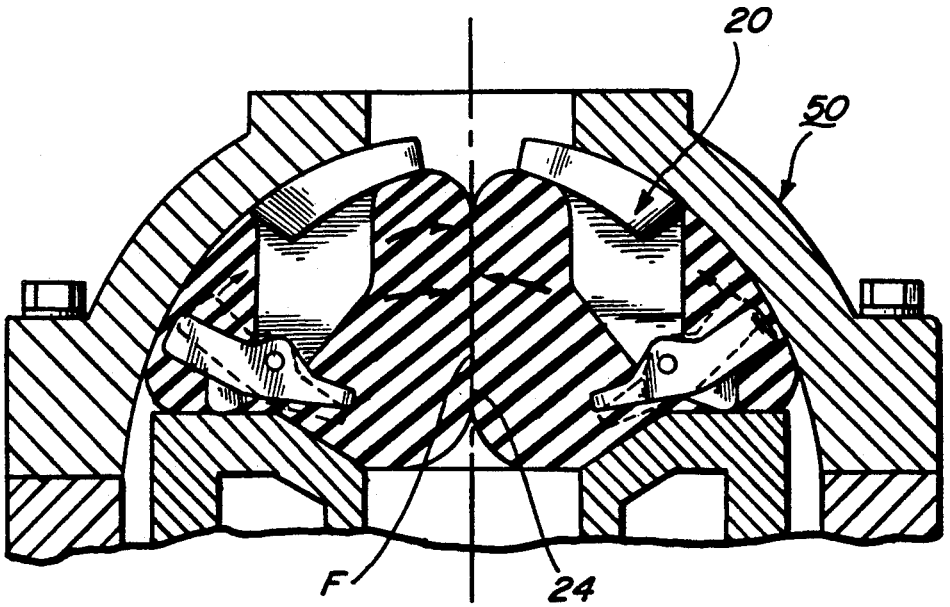
FIG. 8 is a view similar to FIG. 7, but showing diametrically opposed resilient portions of the sealing element in abutting contact, completely sealing off the bore of the blowout preventer.

Referring now especially to FIGS. 6 through 8, the function of the novel annular sealing element 20 according to the present invention may be described. As shown in FIG. 6, the sealing element 20 is installed in an existing blowout preventer 50 of the type having a generally hemispherically-shaped interior space 58 in the upper housing section 52 of the blowout preventer. In the blowout preventer 50 shown in FIG. 6, pivot bar 84 of each segment 26 is shown resting on the flat annular upper surface 82 of the actuator piston 78 of the blowout preventer. Thus positioned, the convex lower cylindrical surface 85 of pivot bar 84 is adapted to pivot on upper surface 82 of actuator piston 78 as the piston moves longitudinally within blowout preventer 50.

In FIG. 6, the blowout preventer 50 is shown in its fully open position, with piston 78 in its lowermost, retracted state. In this position, the bore 24 through sealing element 20, and also through the blowout preventer, is at its maximum diameter value. With sealing element 20 positioned within the blowout preventer 50 as shown in FIGS. 6 through 8, the convexly curved upper outer surface 29 of the tooth-like upper plate section 28 of each circumferentially spaced apart steel segment 26 is in slidable tangent contact with the curved inner surface 97 of upper housing section 52.

To actuate blowout preventer 50 from a fully open position, as shown in FIG. 6, to a sealing position, as shown in FIG. 7, hydraulic actuating pressure is used to drive piston 78 upwards. As piston 78 begins to move upwards, the flat, upper surface 82 of piston 78, which is in abutting contact with the lower surface 85 of pivot bar 84 of compensator plate 31 of each segment 26, exerts a generally upward directed, normal force on the heel of the compensator plate. The upward directed normal force exerted on the lower surface 85 of pivot bar 84 is transmitted through plate 31 and web 30 to upper plate section 28 of each segment 26. This force causes the upper, outer surfaces 29 of upper plate sections 28 of the segments 26 to move slidably upwards and radially inwards on the curved surface 97 of the upper housing 52 of the blowout preventer 50. Radially inward motion of the segments 26 forces cold-flow of the resilient material of matrix 27, in which the segments are imbedded, radially inwards, thus deforming the inner cylindrical wall surface 49 of the matrix to a smaller diameter as piston 78 moves upward.

FIG. 7 shows the sealing element 20 having been moved upwards and radially inwards to form a circumferential sealing contact F with the outer cylindrical surface of a drill string component G, of relatively small diameter. As shown in FIG. 7, the rear heel portion 32 of the compensator base plate 31 of each segment 26 has tilted upwards slightly. The convex curvature of lower surface 85 of pivot bar 84 permits the pivot bar to roll on upper surface 82 of the piston, while still allowing a very large normal closing force to be transmitted from the piston to compensator base plate 31.

As shown in FIG. 7, upward pivotal motion of the rear heel portion 32 of base plate 31 is of course accompanied by downward pivotal motion of the front toe portion 42 of the base plate. Downward motion of the front toe portion 42 of each segment provides a highly effective means for forcing a substantial volume of material of resilient matrix 27 into sealing contact with sloping annular surface 81 of piston 78. The formation of a seal of substantial radial extent made possible by the novel design of the annular seal 20 is highly desirable. This is because a seal of substantial radial extent will inherently withstand higher well-head pressures than a shorter seal. When it is considered that such pressures may be as high as 10,000 psi, the importance of achieving a strong seal can be readily appreciated.

An additional function of toe portion 42 of compensator plate 31 is to direct cold-flow of resilient material of matrix 27 radially inwards towards the center line of bore 24 of the sealing element 20, thus providing a seal of substantially greater length, and accompanying strength, than prior art sealing elements. Toe portion 42 also limits downward flow of resilient material above the toe portion. It should be noted that the pivotal motion of the upper portion 28 of each segment 26 relative to its base plate 31, in conjunction with the fact that no metal contacts a drill string component G within the bore 24 of the sealing element 20, assures that the force exertable on the drill string component is limited, thus preventing damage to the drill string component.

FIG. 8 shows the sealing element 20 having moved upwards and radially inwards sufficiently far for the bore 24 through the sealing element 20 to be constricted to zero diameter, thus completely sealing the blowout preventer with no drill string component within the bore. Again, the novel design of the sealing element 20, discussed above in conjunction with a description of the sealing action of the sealing element on a drill string component, results in a seal having substantial length, and therefore, great strength.

The dashed lines in FIG. 8 illustrate the effectiveness in operation of the sealing element 20 even after a substantial portion of the resilient matrix 27 has been worn away by the continued abrading action on the inner cylindrical wall surface 49 of the matrix, caused by longitudinal motion up and down through the bore 24 of the sealing element, by drill string components being "stripped out" and "stripped in," respectively. As shown in FIG. 8, when resilient material is lost from the matrix 27 for the reasons stated above, the upward force exerted by the piston 78 on the rear heel portion 32 of compensator plate 31 feeds new rubber radially upwards and inwards towards the seal area, as shown by the arrows.

What is claimed is:

1. An improved sealing member for blowout preventers, said sealing member being a generally circularly symmetric composite structure including a resilient matrix having a plurality of circumferentially spaced apart segments, each of said segments comprising an upper section having a convexly curved upper surface, and a sector-shaped lower base plate, said upper section being pivotably joined to said base plate by pivot means, and said base plate having protruding from the lower surface thereof a convexly curved pivot bar element of finite cross-sectional area adapted to pivot on the top of a piston head, the pivotal axis of said pivot bar being transverse to a radius of said sealing member and located radially inwards of the outer circumferential surface of said base plate.

2. The sealing member of claim 1 wherein the pivot axis of said pivot bar is located radially outwards of the pivot axis of said pivot means.

3. An improved sealing member for blowout preventers, said sealing member being of the type having a composite structure comprising a generally circularly symmetric, plano-convex lenticular-shaped body having a generally flat base, a convexly curved upper wall surface, and a cylindrical bore through said body, said body having a plurality of curved metal segments spaced apart at regular circumferential intervals within a resilient matrix, the diameter of said bore being resiliently reducible to effect sealing on a cylindrical component within said bore in response to a longitudinally upwardly directed force on said base of said element while said curved upper surface is forced against a rigid concave surface, said improved sealing member having a plurality of metal segments, each of said segments comprising:

a. an upper section with a tooth-like upper plate section having a convexly curved upper, outer surface coextensive with the convexly curved upper, outer wall surface of said lenticular body, said upper plate section having a supporting web extending downwards from the lower surface of said upper plate, and b. a generally wedge-shaped base plate, said base plate having in plan view the shape of a truncated sector of a circle similar in shape to said upper plate with a generally straight short front truncating chordal plane and a curvilinear rear transverse face, said base plate including pivot means for pivotably supporting the lower end of said web of said upper section, thereby permitting pivotable motion in a vertical plane of said upper section relating to said base plate, the lower surface of said base plate having a transversely disposed convex protrusion of finite cross-sectional area which functions as a pivot bar, thereby adapting said base plate to pivotably move in response to an upwardly directed force exerted by the annular upper surface of a driving piston, said convex protrusion being located between said front chordal plane and said rear transverse face, and said convex protrusion having a smaller radius of curvature than said lower surface of said base plate.

4. The sealing member of claim 3 wherein said pivot bar has a generally cylindrically shaped lower surface, the axis of said cylinder being disposed perpendicularly to the longitudinal center plane of said base plate.

5. The sealing member of claim 4 wherein said cylindrical axis of said pivot bar is located rearward of the pivot axis of said web support pivot means.

6. An annular sealing element for blowout preventers comprising a generally circularly symmetric plano-convex lenticular-shaped body having a convexly curved upper wall surface, a generally annularly-shaped base, and a cylindrical bore extending coaxially through the entire height of said body, said body comprising a matrix of resilient material holding a plurality of imbedded metal segments spaced apart at regular circumferential intervals around said bore at equal radial distances therefrom, each of said segments comprising:

a. an upper section with a tooth-like upper plate section having a convexly curved upper, outer surface coextensive with the upper, outer curved surface of said lenticular body, said tooth-like upper plate section having in plan view the shape of a sector of a spheroid, the vertex of said sector truncated by a transverse chordal edge, said upper plate section having a supporting web of generally uniform thickness extending perpendicularly downwards from the lower surface of said tooth-like upper plate section; and b. a generally wedge-shaped base plate, said base plate having in plan view the shape of a truncated sector of a circle similar in shape to said upper tooth-like plate section, said base plate having a generally curvilinear rear transverse wall surface, said base plate having a longitudinally disposed groove in its upper wall surface, said groove being adapted to pivotably receive the lower end of said web, thereby permitting pivotable motion in a vertical plane of said web, a transverse vertical plane through said axis of pivotably and said base plate defining a front toe portion and a rear heel section of said base plate, the lower surface of said base plate having a transversely disposed cylindrical pivot bar adapted to pivot on the annular surface of a driving piston, said pivot bar of finite cross-sectional area being located forward of said rear transverse wall surface of said base plate.

7. The sealing element of claim 6 wherein the cylindrical axis of said pivot bar is located rearwards of said web pivot axis.

8. An improved support segment for sealing members of the type employing a plurality of segments at spaced apart intervals within a lenticular-shaped resilient matrix, said element comprising:

a. an upper section with a tooth-like upper plate section having a convexly curved upper, outer surface coextensive with the upper, outer curved surface of said lenticular body, said tooth-like upper plate section having in plan view the shape of a sector of a spheroid, the vertex of said sector truncated by a transverse chordal edge, said upper plate section having a supporting web of generally uniform thickness extending perpendicularly downwards from the lower surface of said tooth-like upper plate sections, and b. a generally wedge-shaped base plate, said base plate having in plan view the shape of a truncated sector of a circular similar in shape to said upper tooth-like plate section, said base plate having a generally curvilinear rear transverse wall surface, said base plate having a longitudinally disposed groove in its upper wall surface, said groove being adapted to pivotably receive the lower end of said web, thereby permitting pivotable motion in a vertical plane of said web, a transverse vertical plane through said axis of pivotably and said base plate defining a front toe portion and a rear heel section of said base plate, the lower surface of said base plate having a transversely disposed cylindrical pivot bar adapted to pivot on the annular surface of a driving piston, said pivot bar of finite cross-sectional area being located forward of said rear transverse wall surface of said base plate.

9. The segment of claim 8 wherein the cylindrical axis of said pivot bar is located rearward of said web pivot axis.

10. The segment of claim 9 wherein said base plate has formed in opposite side walls thereof, adjacent said groove, a pair of bosses adapted to hold a transversely and horizontally disposed pivot pin for pivotably supporting said lower end of said web.

* * * * *